US006938729B2

(12) United States Patent
Wörner et al.

(10) Patent No.: US 6,938,729 B2
(45) Date of Patent: Sep. 6, 2005

(54) EXHAUST GAS SYSTEM

(75) Inventors: Siegfried Wörner, Esslingen (DE); Ulrich Sigel, Plochingen (DE)

(73) Assignee: J. Ebersdacher GmbH & Co. KG, Esslingen (DE)

( * ) Notice: Subject to any disclaimer, the term of this patent is extended or adjusted under 35 U.S.C. 154(b) by 0 days.

(21) Appl. No.: 10/614,301

(22) Filed: Jul. 3, 2003

(65) Prior Publication Data

US 2004/0006970 A1 Jan. 15, 2004

(30) Foreign Application Priority Data

Jul. 10, 2002 (DE) ..... 102 31 056

(51) Int. Cl.[7] ..... F01N 1/04; F01N 1/24; F01N 7/04

(52) U.S. Cl. ..... 181/254; 181/237; 181/241; 181/232; 181/272; 60/324; 60/313; 60/290; 60/292

(58) Field of Search ..... 181/254, 236, 181/237, 238, 240, 241, 232, 251, 272, 275, 278; 60/322–324, 313, 290, 287, 292

(56) References Cited

U.S. PATENT DOCUMENTS

| | | | | | |
|---|---|---|---|---|---|
| 4,926,636 | A | * | 5/1990 | Tadokoro et al. | 181/254 |
| 5,014,817 | A | * | 5/1991 | Takato et al. | 181/254 |
| 5,113,652 | A | * | 5/1992 | Baines et al. | 60/324 |
| 5,134,850 | A | * | 8/1992 | Saito et al. | 60/313 |
| 5,301,503 | A | * | 4/1994 | Martinelli | 60/288 |
| 5,351,481 | A | | 10/1994 | Flugger | |
| 5,388,408 | A | * | 2/1995 | Lawrence | 60/324 |
| 6,178,745 | B1 | * | 1/2001 | Meusen | 181/254 |
| 6,454,047 | B1 | * | 9/2002 | Galaitsis | 181/254 |
| 6,557,341 | B2 | * | 5/2003 | Bubeck et al. | 60/287 |
| 6,584,767 | B1 | * | 7/2003 | Koenig | 60/324 |
| 6,598,390 | B2 | * | 7/2003 | Chang | 60/323 |
| 6,633,646 | B1 | * | 10/2003 | Hwang | 181/228 |
| 6,662,554 | B2 | * | 12/2003 | Sheidler et al. | 60/290 |
| 6,708,798 | B2 | * | 3/2004 | Chang | 181/226 |
| 6,772,588 | B2 | * | 8/2004 | Yamada et al. | 60/313 |
| 2002/0175022 | A1 | * | 11/2002 | Schumacher et al. | 181/254 |

FOREIGN PATENT DOCUMENTS

| | | | | |
|---|---|---|---|---|
| DE | 6803317 | | 10/1968 | |
| DE | 44 44 098 | A1 | 10/1994 | F01N/7/04 |
| DE | 197 43 446 | A1 | 10/1997 | F01N/1/02 |
| DE | 202 00 754 | U1 | 10/2002 | F01N/7/04 |
| JP | 01273819 | A * | 11/1989 | F01N/7/02 |
| JP | 04012145 | A * | 1/1992 | F02D/33/00 |

* cited by examiner

*Primary Examiner*—Edgardo San Martin

(57) ABSTRACT

An exhaust gas system for an internal combustion engine, in particular, of a motor vehicle has two mufflers through which the exhaust gas is able to flow in a parallel fashion. A switching unit makes it possible to selectively convey the exhaust gas flow of the internal combustion engine only or almost exclusively through the first muffler, or only or almost exclusively through the second muffler, or through both mufflers in a parallel fashion. The two mufflers are realized differently with respect to their muffling effect and/or flow resistance.

16 Claims, 1 Drawing Sheet

EXHAUST GAS SYSTEM

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention pertains to an exhaust gas system for an internal combustion engine, in particular, of a motor vehicle.

The combustion gases produced during operation of an internal combustion engine are conveyed from the cylinder head of the internal combustion engine into an exhaust gas pipe assembly that discharges the exhaust gases into the surroundings by means of exhaust manifolds. The inlet of the exhaust gas pipe assembly may also contain an exhaust gas accumulator for each cylinder bank of the internal combustion engine, wherein the manifold pipes lead into this exhaust gas accumulator, and wherein the exhaust gas accumulator introduces the thusly combined exhaust gas flow of the individual cylinders into the exhaust gas pipe assembly. Devices for conditioning and/or cleaning the exhaust gas, e.g., a catalytic converter and/or a particle filter, may be arranged in the exhaust gas pipe assembly. It is common practice to also arrange at least one muffler in the exhaust gas pipe assembly in order to reduce or influence the noise of the internal combustion engine that is emitted into the surroundings. With respect to the dimensions and the design of such mufflers, it was determined that an increased muffling effect is associated with an increase in the flow resistance of the muffler, at least in instances in which the muffler has a compact design. An increased flow resistance causes the exhaust gas back-pressure to increase at the exhaust gas outlet of the internal combustion engine. However, the power of the internal combustion engine undesirably decreases as the exhaust gas back pressure increases. In the design of mufflers, the attainable muffling effect consequently is limited by the associated power drop of the internal combustion engine.

The available space, in particular, in motor vehicles may make it necessary to realize the exhaust gas system with two exhaust gas pipe assemblies, through which the exhaust gas flows in a parallel fashion and which either branch off a common exhaust gas pipe that is connected to the internal combustion engine or are separately connected to the internal combustion engine, preferably in V-engines. An exhaust gas system with two exhaust gas pipe assemblies, through which the exhaust gas flows in a parallel fashion, is also referred to as a "double pipe system." In such a double pipe system, it is possible to respectively arrange at least one muffler in each of the two parallel exhaust gas pipe assemblies. Since the volume flow is cut in half, these mufflers can have a relatively compact design, wherein an improved muffling effect can be achieved at a comparatively low flow resistance.

SUMMARY OF THE INVENTION

The object of the present invention is to disclose an improved embodiment of an exhaust gas system of the initially described type which, in particular, provides a sufficient muffling effect and simultaneously allows a power increase of the internal combustion engine.

This object is attained by an exhaust gas system for an internal combustion engine, in particular, of a motor vehicle, with two mufflers, through which the exhaust gas is able to flow in a parallel fashion, wherein a switching unit is provided which makes it possible to selectively convey the exhaust gas flow of the internal combustion engine only or almost exclusively through the first muffler or only or almost exclusively through the second muffler or through both mufflers in a parallel fashion, and wherein the two mufflers are realized differently with respect to their muffling effect and/or flow resistance. Advantageous embodiments that support the object of the invention are described according to the invention.

In an exhaust gas system with two mufflers, through which the exhaust gas is able to flow in a parallel fashion, the present invention proposes that the two mufflers are realized differently with respect to their muffling effect and/or flow resistance, and that a switching unit is provided that makes it possible to selectively activate only or almost exclusively the first muffler or only or almost exclusively the second muffler or both mufflers. A corresponding actuation of the switching unit consequently makes it possible to select between different muffling effects and/or between different flow resistances and—in dependence thereon—between different powers of the internal combustion engine. The invention utilizes the fact that the internal combustion engine, in particular, of a motor vehicle is usually not permanently operated at maximum power. To the contrary, only a low power is required in numerous operating phases. For example, the power of the internal combustion engine is only of minor importance in the idling mode of the internal combustion engine. The exhaust gas system according to the invention makes it possible to provide an improved muffling effect for operating phases, in which a power drop of the internal combustion engine can be accepted, as well as to lower the exhaust gas back-pressure for operating phases, in which the power of the internal combustion engine should be largely uninhibited. In the latter-mentioned instance, the associated decrease in the muffling effect is acceptable or even desirable, for example, in order to produce an acoustic feedback of the increased power in the form of a "sports car sound."

According to one advantageous additional development, the first muffler is designed in such a way that an optimized muffling effect is achieved, in particular, for lower frequencies. The second muffler is designed in such a way that an optimized power of the internal combustion engine is achieved. This design of the mufflers makes it possible to realize an optimal muffling effect at a low power requirement of the internal combustion engine and to lower the exhaust gas back-pressure at a higher power requirement.

In order to actuate the switching unit, the invention proposes to provide a control device that makes it possible to actuate the switching unit in dependence on the engine load and/or the speed of the internal combustion engine. The engine load corresponds to the power, and the speed is correlated with the exhaust gas volume flow. The flow resistance of the mufflers is also dependent on the exhaust gas volume flow such that the exhaust gas back-pressure increases proportionally with the volume flow. This means that the speed represents an important parameter for the actuation of the switching unit.

In one advantageous additional development, the control device is able to actuate the switching unit in such a way that the exhaust gas only or predominantly flows through the first muffler in a lower speed range, that the exhaust gas only or predominantly flows through the second muffler in the medium speed range, and that the exhaust gas flows through both mufflers in a parallel fashion in an upper speed range. This embodiment of the exhaust gas system can be very easily realized in such a way that it is optimized with respect to the muffling effect for smaller exhaust gas volume flows and with respect to the power of the internal combustion engine for medium exhaust gas volume flows. Both mufflers are active for higher volume flows in order to lower the total flow resistance of the exhaust gas system.

BRIEF DESCRIPTION OF THE DRAWING

Other important characteristics and advantages of the invention are disclosed according to the invention, the FIGURE and the description that refers to the FIGURE.

It goes without saying that the aforementioned characteristics, as well as the characteristics disclosed below, cannot only be utilized in the respectively described combination, but also in other combinations or independently without deviating from the scope of the present invention.

Figure 1:
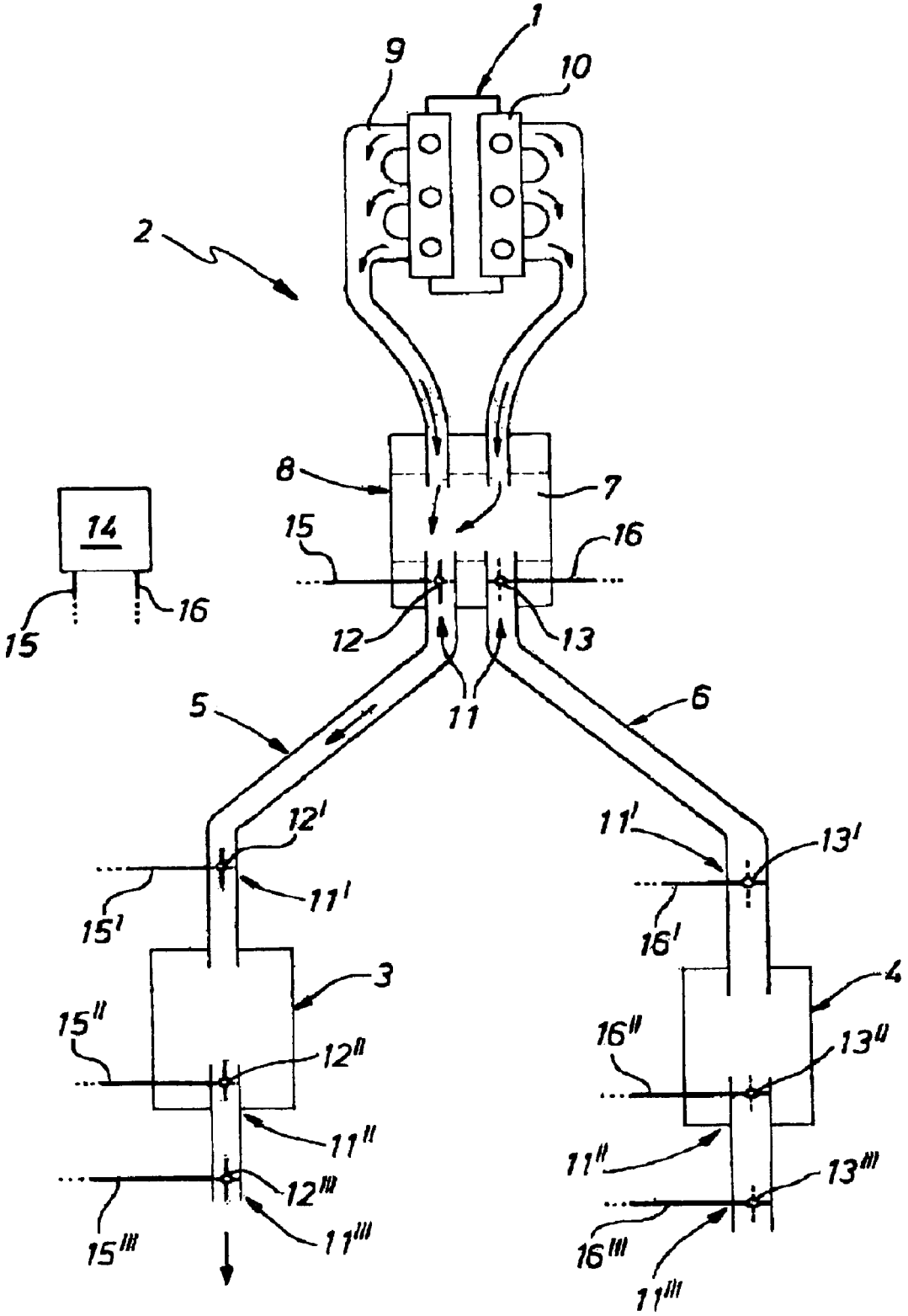

One embodiment of the invention is illustrated in the FIGURE and described in greater detail below.

FIG. 1 shows a schematic circuit diagram of an exhaust gas system according to the invention.

DETAILED DESCRIPTION OF THE INVENTION

According to FIG. 1, an internal combustion engine 1, in particular, of a motor vehicle is equipped with an exhaust gas system 2 according to the invention. This exhaust gas system 2 comprises at least two mufflers, through which the exhaust gas is able to flow in a parallel fashion, namely a first muffler 3 and a second muffler 4 that, for example, are realized in the form of rear mufflers. It would, in principle, be possible to arrange both mufflers 3, 4 in one common exhaust gas pipe assembly in such a way that the exhaust gas is able to flow through both mufflers in a parallel fashion. However, in the preferred embodiment shown, the exhaust gas system 2 comprises two parallel exhaust gas pipe assemblies, namely a first exhaust gas pipe assembly 5 and a second exhaust gas pipe assembly 6, wherein one of the mufflers 3, 4 is respectively arranged in each exhaust gas pipe assembly. In this context, it is important that the two exhaust gas pipe assemblies 5, 6 are connected to one another in a communicating fashion upstream of the two mufflers 3, 4. In the embodiment shown, this communicating connection is produced in a common mixing chamber 7, to which both exhaust gas pipe assemblies 5, 6 are connected. This mixing chamber 7 may be realized in a third muffler 8 in accordance with the embodiment shown, wherein said third muffler is realized in the form of a center muffler and effective for both exhaust gas pipe assemblies 5, 6 in this case.

In another embodiment, the third muffler 8 may also be realized in the form of a front muffler, wherein this arrangement would, in principle, make it possible to incorporate corresponding not-shown center mufflers into the individual exhaust gas pipe assemblies 5, 6, namely between the front muffler 8 and the rear mufflers 3, 4. It would also be conceivable to realize the third muffler 8 in the form of a combined front and center muffler.

In the embodiment shown, both exhaust gas pipe assemblies 5, 6 are separately connected to the internal combustion engine 1. This is particularly advantageous if the internal combustion engine 1 consists of a V-engine. In the embodiment shown, the internal combustion engine 1 consists of a V-6 engine with two cylinder banks 9, 10 that respectively comprise three cylinders. The exhaust gas pipe assemblies 5, 6 convey the exhaust gases produced in the respective cylinder banks 9, 10 to a common center muffler 8 and introduce the combustion gases into the mixing chamber 7. In another embodiment, the two parallel exhaust gas pipe assemblies 5, 6 may also be connected to an internal combustion engine 1 with in-line cylinders via a common main pipe. This main pipe leads into the mixing chamber 7 or—if no center muffler is provided—branches off into the two parallel exhaust gas pipe assemblies 5, 6.

The exhaust gas system 2 according to the invention also comprises a switching unit 11, several variations 11, 11', 11", 11'" of which are illustrated in the FIGURE. In the particularly simple embodiment shown, the switching unit 11 of each variation comprises two separate switching elements 12, 13 and 12', 13' and 12", 13" and 12'", 13'". These switching elements 12, 13 are respectively assigned to one of the rear mufflers 3, 4 and correspondingly arranged at a suitable location in the respective exhaust gas pipe assemblies 5, 6. The variations of the switching unit 11, 11', 11", 11'" differ with respect to the different positions of their switching elements 12, 13; 12', 13'; 12", 13"; 12'", 13'" within the parallel exhaust gas pipe assemblies 5, 6. In the first variation, the switching elements 12, 13 of the switching unit 11 are integrated into the center muffler 8. In the second variation, the switching elements 12', 13' of the switching unit 11' are respectively installed in the exhaust gas pipe assemblies 5, 6 between the center muffler 8 and the corresponding rear mufflers 3 and 4. In the third variation, the switching elements 12", 13" of the switching unit 11" are integrated into the respective rear mufflers 3 and 4. According to the fourth variation, the switching elements 12'", 13'" of the switching unit 11'" may also be arranged in the respective exhaust gas pipe assemblies 5 and 6 downstream of the rear mufflers 3, 4. The different positions of the individual switching elements 12, 13 may also be arbitrarily combined. In the following description, only the switching elements 12, 13 of the switching unit 11 according to the first variation are expressly mentioned; it goes without saying that this description also applies accordingly to the switching elements 12', 13'; 12", 13"; 12'", 13'" and the switching units 11', 11", 11'" of the other variations.

The switching elements 12, 13 are realized in the form of simple flaps that can be adjusted, in particular, changed over between an open position and a closed position. In the state illustrated in FIG. 1, the first switching element 12 assigned to the first exhaust gas pipe assembly 5 is in its open position and drawn with a continuous line. Its closed position is indicated with a broken line. The switching element 13 assigned to the second exhaust gas pipe assembly 6 is, in contrast, illustrated in its closed position and drawn with a continuous line, wherein the corresponding open position is indicated with a broken line. The switching elements 12, 13 are able to close and open the exhaust gas path in the respective exhaust gas pipe assemblies 5, 6 depending on their switching position. This means that the respective exhaust gas pipe assemblies 5, 6 and the corresponding rear mufflers 3, 4 arranged therein are either active and allow the exhaust gas to pass or inactive and prevent the exhaust gas from passing depending on these switching positions.

The switching unit 11 and its switching elements 12, 13 are connected to a control device 14, wherein corresponding control lines 15, 16 are provided for this purpose. The control device 14 can be integrated into the hardware of an engine control of the internal combustion engine 1 and/or implemented in the form of software. In any case, the control device 14 has access to operating parameters of the internal combustion engine 1 and receives, in particular, information on the current speed of the internal combustion engine 1, as well as on the current engine load or power of the internal combustion engine 1.

According to the invention, the two mufflers 3, 4, through which the exhaust gas is able to flow in a parallel fashion, are realized differently with respect to their muffling effect and/or with respect to their flow resistance. According to an embodiment, the two parallel mufflers 3 and 4 are designed such that the first muffler 3 has a superior muffling effect, preferably for lower frequencies, and a higher flow resistance than the second muffler 4 that preferably is designed for muffling higher frequencies. In one embodiment, the first muffler 3 is realized in such a way that it has an optimized muffling effect with respect to the occurring exhaust gas volume flows and noise development. The second muffler 4, in contrast, has such dimensions that an optimal power of the internal combustion engine 1 can be achieved for certain operating states, for example, due to the fact that the second muffler 4 has a relatively small flow resistance such that only a relatively low exhaust gas back pressure is built up even at higher exhaust gas volume flows. This favorably affects the power of the internal combustion engine 1.

The switching unit 11 is realized in such a way that it is able to selectively activate only the first exhaust gas pipe assembly 5 and the first muffler 3 or only the second exhaust gas pipe assembly 6 and the second muffler 4 or both exhaust gas pipe assemblies 5, 6 and both mufflers 3, 4 in a parallel fashion. In the switching position shown in FIG. 1, only the first exhaust gas pipe assembly 5 and the first muffler 3 are activated. Accordingly, the second exhaust gas pipe assembly 6 and the second muffler 4 are deactivated in FIG. 1.

In the embodiment shown, the activation and deactivation of the individual exhaust gas pipe assemblies 5, 6 and their mufflers 3, 4 are realized by setting the switching elements 12, 13 into corresponding switching positions. In another embodiment, the switching unit 11 only requires a single switching element that operates similar to a multiple-way valve and selectively conveys the exhaust gas flow only to the first muffler 3 or only to the second muffler 4 or to both mufflers 3 and 4 in a parallel fashion.

The control device 14 is designed in such a way that it actuates the switching unit 11 and its switching elements 12, 13 in dependence on the engine load and/or the speed of the internal combustion engine 1. A speed-dependent actuation of the switching unit 11 may, for example, be realized in such a way that the control device 14 adjusts the state shown in FIG. 1 in a lower speed range, wherein the exhaust gas flow of the internal combustion engine 1 only flows through the first muffler 3 in this case. Since the first muffler 3 is optimized with respect to its muffling effect, an effective muffling is achieved and only little noise is emitted into the environment. Although the first muffler 3 has a relatively high flow resistance, this high flow resistance does not cause a significant increase in the exhaust gas back pressure at slower speeds, i.e., at smaller exhaust gas volume flows. In addition, the internal combustion engine 1 usually does not have to deliver a particularly high power in a lower speed range, in particular, in the range of the idling speed. The control device 14 changes over the flow paths in a medium speed range that, for example, lies between 1000 and 3000 rpm. This means that the exhaust gas now exclusively flows through the second exhaust gas pipe assembly 6 and consequently through the second muffler 4 while the first exhaust gas pipe assembly 5 and the first muffler 3 are deactivated. Since the second muffler 4 is, according to the invention, realized with the smallest possible flow resistance, only a relatively low exhaust gas back pressure is built up when the exhaust gas flows through the second muffler 4, namely even at relatively high exhaust gas volume flows. This favorably affects the power of the internal combustion engine 1. At a high power requirement, a reduced muffling effect occurs, in particular, in the low-frequency range. However, this is acceptable if the power of the internal combustion engine needs to be increased, in particular, since the muffling effect in the high-frequency range can be improved. In certain instances, a more intense noise development—at least with lower frequencies—is even desired in order to provide the driver with an audible feedback on the operating state of the internal combustion engine 1 in the form of the generated "sports car sound."

At even higher speeds, i.e., in an upper speed range, the second exhaust gas pipe assembly and the second muffler 4 no longer suffice for ensuring a sufficiently low exhaust gas back-pressure. In such instances, the control device 14 actuates the switching unit 11 in such a way that the first exhaust gas pipe assembly 5 and consequently the first muffler 3 are additionally activated. In one simple embodiment, this actuation may take place in only one stage, i.e., the switching unit 11 and its first switching element 12 are directly changed over from the closed position into the open position with respect to the first muffler 3.

In one additional development, the switching unit 11 may also be realized in such a way that a multi-stage or continuous activation of the first muffler 3 is achieved. For example, the control device 14 may activate the first muffler 3 in dependence on the speed in a transition range between the medium speed range and the upper speed range. The first switching element 12 is, for example, gradually opened in dependence on the speed. This variation makes it possible to further positively influence the power of the internal combustion engine 1, as well as the muffling effect of the exhaust gas system 2.

In another embodiment, it may also be practical to convey the exhaust gas flow not entirely through the first muffler 3 in the lower speed range, but merely in almost its entirety, e.g., at least 80% or at least 90%. This can be achieved by changing over the second switching element 13 into a throttling position, in which it is not entirely closed. Accordingly, it may be advantageous to convey the exhaust gas flow not entirely through the second muffler 4, but merely in almost its entirety, in particular, at least 80% or at least 90%. This can also be achieved by changing over the first switching elements 12 into a corresponding throttling position that deviates from the closed position. In a motor vehicle, in which one exhaust gas pipe assembly 5 (or 6) ends on the left rear end of the motor vehicle and the other exhaust gas pipe assembly 6 (or 5) ends on the right rear end of the motor vehicle, this measure makes it possible to prevent or at least reduce a shift of the noise in the interior of the motor vehicle from the left side to the right side or vice versa when the switching states are changed over, in particular, between the lower speed range and the medium speed range.

We claim:

1. An exhaust gas system for an internal combustion engine (1) of a motor vehicle, comprising two mufflers (3,4), through which the exhaust gas is able to flow in a parallel fashion, wherein a switching unit (11) is provided which makes it possible to selectively convey the exhaust gas flow of the internal combustion engine (1) only or almost exclusively through the first muffler (3), or only or almost exclusively through the second muffler (4), or through both mufflers (3,4) in a parallel fashion, and wherein the two mufflers (3,4) are provided differently with respect to their muffling effect or flow resistance, and wherein a control device (14) is provided which actuates the switching unit (11) in dependence on the engine load or the speed of the internal combustion engine (1), and wherein the control device (14) actuates the switching unit (11) so that the exhaust gas predominantly flows through the first muffler (3) in a low speed range, predominantly flows through the second muffler (4) in a medium speed range, and flows through both mufflers (3,4) in a parallel fashion in an upper speed range.

2. The exhaust gas system according to claim 1, wherein the first muffler (3) has a higher muffling effect than the second muffler (4).

3. The exhaust gas system according to claim 1, wherein the second muffler (4) has a lower flow resistance than the first muffler (3).

4. The exhaust gas system according to claim 1, wherein the first muffler (3) is designed for achieving an optimized muffling effect while the second muffler (4) is designed for achieving an optimized power of the internal combustion engine.

5. The exhaust gas system according to claim 1, wherein the first muffler (3) is designed for muffling low frequencies while the second muffler (4) is designed for muffling high frequencies.

6. The exhaust gas system according to claim 1, wherein the switching unit (11) can activate the second muffler (4) and additionally activate the first muffler continuously or in several stages.

7. The exhaust gas system according to claim 1, wherein two parallel exhaust gas pipe assemblies (5,6) are provided, wherein one of the mufflers (3,4) is respectively arranged in each exhaust gas pipe assembly, and wherein the exhaust gas pipe assemblies are connected to one another in a communicating fashion upstream of the mufflers (3,4).

8. The exhaust gas system according to claim 7, wherein both exhaust gas pipe assemblies (5,6) branch off a common master pipe that is connected to the internal combustion engine (1).

9. The exhaust gas system according to claim 7, wherein both exhaust gas pipe assemblies (5,6) are separately connected to the internal combustion engine (1) and contain a common mixing chamber (7) between the internal combustion engine (1) and the mufflers (3,4), wherein the two exhaust gas pipe assemblies (5,6) communicate with one another via said mixing chamber.

10. The exhaust gas system according to claim 7, wherein a third muffler (8) is provided, wherein the two exhaust gas pipe assemblies (5,6) communicate with one another in this third muffler.

11. The exhaust gas system according to claim 10, wherein the switching unit (11) is integrated into the third muffler (8).

12. The exhaust gas system according to claim 1, wherein the switching unit (11) contains two switching elements (12,13) that are respectively assigned to the first and the second muffler (3,4) and designed for opening or closing the exhaust gas path leading to the assigned muffler (3,4).

13. The exhaust gas system according to claim 12, wherein the two switching elements (12", 13") are respectively integrated into the first and the second muffler (3,4).

14. The exhaust gas system according to claim 1, wherein the first muffler (3) and the second muffler (4) are respectively in the form of rear mufflers relative to the structure of the motor vehicle.

15. The exhaust gas system according to claim 10, wherein the third muffler (8) is in the form of a central muffler or a front muffler relative to the structure of the motor vehicle.

16. An exhaust gas system for an internal combustion engine (1) of motor vehicle, comprising two mufflers (3,4), through which the exhaust gas is able to flow in a parallel fashion, wherein a switching unit (11) is provided which makes it possible to selectively convey the exhaust gas flow of the internal combustion engine (1) only or almost exclusively through the first muffler (3), or only or almost exclusively through the second muffler (4), or through both mufflers (3,4) in a parallel fashion, and wherein the two mufflers (3,4) are provided differently with respect to their muffling effect or flow resistance, and wherein a control device (14) is provided which actuates the switching unit (11) in dependence on the engine load or the speed of the internal combustion engine (1), and wherein the control device (14) actuates the switching unit (11) so that the exhaust gas predominantly flows through the first muffler (3) in a low speed range, predominantly flows through the second muffler (4) in a medium speed range, and flows through both mufflers (3,4) in a parallel fashion in an upper speed range wherein a control device (14) is provided which actuates the switching unit (11) in dependence on the engine load or the speed of the internal combustion engine (1), and wherein the control device (14) actuates the switching unit (11) so that the exhaust gas: predominantly flows through the first muffler (3) in a low speed range, predominantly flows through the second muffler (4) in a medium speed range, and flows through both mufflers (3,4) in a parallel fashion in an upper speed range, and wherein the control device (14) actuates the switching unit (11) so that at least 80% or at least 90% of the exhaust gas flow through the first muffler (3) in the lower speed range and at least 80% or at least 90% of the exhaust gas flow through the second muffler (4) in the medium speed range.

* * * * *